United States Patent [19]

Mouissie

[11] Patent Number: 5,057,037

[45] Date of Patent: Oct. 15, 1991

[54] CONNECTOR

[75] Inventor: Bob Mouissie, Berlicum, Netherlands

[73] Assignee: E. I. Du Pont de Nemours and Company, Wilmington, Del.

[21] Appl. No.: 644,386

[22] Filed: Jan. 22, 1991

[30] Foreign Application Priority Data

Feb. 23, 1990 [DE] Fed. Rep. of Germany ..... 9002181

[51] Int. Cl.[5] ..... H01R 13/12

[52] U.S. Cl. ..... 439/495

[58] Field of Search ..... 439/492–499

[56] References Cited

U.S. PATENT DOCUMENTS 3,983,745 7/1975 Codrino ..... 439/495

4,908,336 3/1990 Mouissie ..... 439/496

*Primary Examiner*—Joseph H. McGlynn

[57] ABSTRACT

A connector for contacting one or more conductor tracks provided on a flexfoil to corresponding conducting inserts. The body of the connector is from insulating material and provided with at least one insert hole for inserting an insert to be contacted and a recess for receiving at least part of the flexfoil. Said recess overlaps the insert hole and is in connection with the insert hole in the region of overlap. A spring clip has to be inserted in the connector such that the conductor tracks face the associated insert holes and the spring clip bears against the side of the flexfoil facing from the conductor tracks. The said clip presses the conductor tracks at least partially into the respective insert holes. The spring clip comprises strips and is provided on both their longitudinal edges with fastening elements engaging in the recess wall.

11 Claims, 5 Drawing Sheets

CONNECTOR

FIELD OF THE INVENTION

The invention relates to a connector for connecting one or more conductor tracks provided on a flexfoil to corresponding conducting inserts.

BACKGROUND OF THE INVENTION

A connector for contacting one or more conductor tracks provided on a flexfoil to corresponding conducting inserts is described in applicant's U.S. Pat. No. 4,908,336. The connector shown in this patent comprises a body of insulating material, which is provided with at least one insert hole for inserting an insert to be contacted and a recess for receiving at least part of the flexfoil, which recess overlaps the insert hole and is in connection with the insert hole in the region of overlap, as well as a spring clip, in which connector, in the assembled position, the conductor tracks face the associated insert holes and the spring clip, bearing against the side of the flexfoil facing from the conductor tracks, presses the conductor tracks at least partially into the respective insert holes.

By means of such a connector, a number of conductor tracks provided on a flexible strip, also referred to as flexfoil, are contacted to inserts in the form of contact pins. By a U-shaped spring clip, two spring clip legs, attached in recesses on either side of the body, are pressed against two contact pins inserted into the respective insert holes.

Furthermore, as shown in U.S. Pat. No. 3,893,745, a U-shaped spring clip is also used to press a conductor track against a contact pin. The spring clip is arrested in an insert hole wider as to the contact pin.

SUMMARY OF THE INVENTION

The object of the invention is to provide an above-mentioned connector in which the spring clip has a simple form.

This object is achieved according to the invention by the spring clip comprising strips which are provided on both their longitudinal edges with fastening elements engaging in the recess wall.

This connector has the advantage that, in spite of the simple form of the spring clip, a good contact pressure between the conductor tracks and contact pins is nevertheless achieved. Due to the simple form of the spring clip, it can be produced in an easy way. Moreover, the connector is easy to assemble, that is without special tools.

According to one embodiment of the invention, the fastening elements of the spring clip comprise resilient fastening lugs extending transversely with respect to the spring clip surface, the distance between the outwardly bent-away, free ends of these lugs being greater than the distance between the recess walls adjacent to these ends and the said recess walls having wall clearances, in which the corresponding lug ends are able to snap into place.

According to a further embodiment of the invention, the fastening elements of the spring clip comprise fastening lugs extending transversely with respect to the spring clip surface, the end faces of which lugs are of a sawtooth-like design and engage in wall clearances of the body recess adjacent to these end faces, which wall clearances are formed by the sawteeth during insertion of the spring clip, the tips of the sawteeth lying in a plane running at an acute angle with respect to the bottom surface of the spring clip.

The angle is preferably 5°.

In one design of the connector according to the invention, the free end of the spring clip lying above the insert hole is provided with a spring clip end part bent-away in the direction of the insert hole.

The contact pressure between conductor track and contact pin can be set in an easy way by the degree of bending-away of the spring clip end part. At the same time, it must be ensured that the degree of bending-away is not too great, as otherwise the insertion of the contact pin is made difficult.

An easy insertion is achieved by the bent-away spring clip end part being followed by a bent-back spring clip end part.

Preferably, the body is provided on the insert side of the insert hole with an inwardly protruding bearing lug, against which the free end of the spring clip, lying above the insert hole, bears with prestress. As a result, the contact pressure is further improved without making the insertion of the contact pin difficult, while the setting of the contact pressure can be made in an easy way by appropriate choice of the prestress.

In the case of a further embodiment of the invention, the walls of the recess of the body adjacent to the longitudinal edges of the flexfoil are provided above the insert hole with slits for receiving the flexfoil projections provided at the free end of the flexfoil, running transversely with respect to the latter and sideways. These flexfoil projections are secured in the respective slits, thereby preventing the flexfoil being pushed away during the insertion of contact pins.

If the flexfoil extends until between the spring clip end part and the bearing lug, this flexfoil is securely held in its position in an advantageous way, so that the said strip is not pushed away by insertion of the contact pin.

The pushing-away of the flexfoil is prevented in an even better way if the spring clip end part lying above the insert hole has at its free end a narrower engaging projection for engaging in respective holes provided in the part to be introduced of the flexfoil.

The further subclaims describe advantageous means of pull relief for the flexfoil.

BRIEF DESCRIPTION OF THE DRAWING

FIG. 6 shows a sectional view of a further design of a connector according to the invention;

DESCRIPTION OF THE PREFERRED EMBODIMENTS

Figure 1:
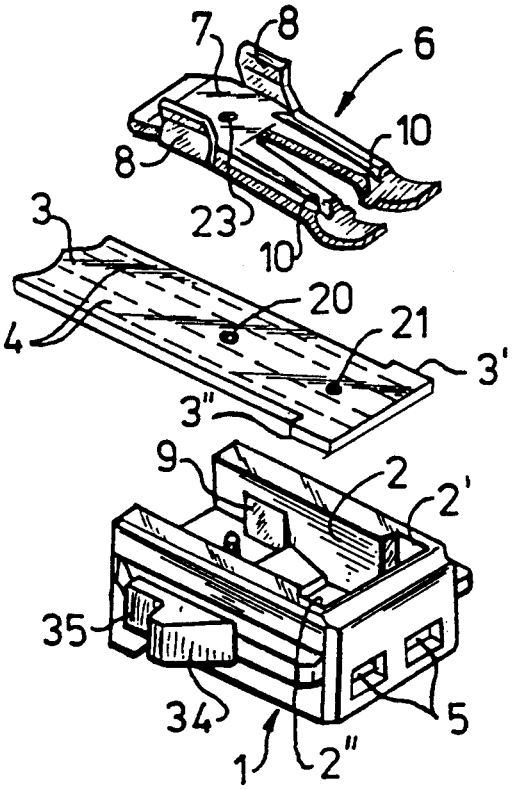
FIG. 1 shows a plan view of a two-position connector according to the invention with disassembled lower parts.
Figure 2:
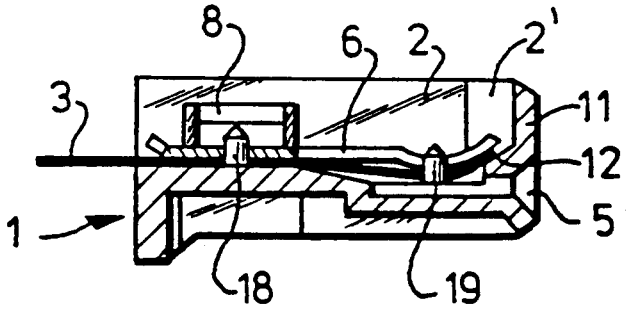
FIG. 2 shows a sectional view of the assembled connector according to FIG. 1.

In FIGS. 1 and 2, a first embodiment of a connector according to the invention is presented. The base part of the connector is a body 1, produced from insulating material, in which a recess 2 for receiving the end part of a flexfoil 3 is provided. On the underside of the flexfoil 3 are the conductor tracks 4.

The body 1 also has two insert holes 5 for the insertion of conducting inserts to be contacted, which inserts are in this design formed by two contact pins of rectangular cross-section (not shown). The insert holes 5 run partially below the recess 2 and are consequently partially overlapped by this recess. In the region of overlap, the recess 2 goes over to the insert holes 5.

The flexfoil 3 is securely held in the recess 2 by means of a spring clip 6 and in particular the conducting tracks 4 in the region of overlap of recess 2 and the insert holes 5 are pushed until approximately in the said insert holes. When the contact pins are inserted in the respective insert holes 5, these pins are contacted to the corresponding conductor tracks by the contact pressure produced by the bent-out spring clip.

The spring clip 6 comprises a lower surface 7, from the edges of which two fastening lugs 8 extend virtually transversely with respect to the said surface 7. The free ends of the fastening lugs 8 are to some extent bent away outwards, to be precise protrude past the surface running transversely with respect to the lower surface 7 and through the edges. The distance between the end edges of the fastening lugs 8 is intended to be greater than that between recess walls 2 adjacent to these ends. These recess walls have wall clearances 9, only one of which is visible in FIG. 1. In the assembled state of the connector, the free ends of the fastening lugs snap into the corresponding said wall clearances 9. Consequently, the spring clip 7 is securely fitted together with the flexfoil 3 in the recess 2.

The spring clip 6 is preferably provided with two spring clip legs 10, in order to ensure an appropriate contact pressure for each contact between the conductor tracks 4 and the contact pins. The end of the spring clip legs 10 has a part which is bent down and a part which is bent back again. This design of the spring clip end part makes the insertion of the contact pins easy. The front wall 11 of the recess 2 is provided with an inwardly protruding bearing lug 12. The end edge part of the curved part of the spring clip 6 rests on this bearing lug 12, preferably under a predetermined prestress. The length of the curved part of the spring clip 6 and its curvature are adapted in such a way to the height of the bearing lug 12 that the conductor tracks 4 lying on the flexfoil 3 are pushed until approximately in the insert holes 5. As a result, the contact pressure between the conductor tracks and the inserted contact pins has been further improved, while a very easy insertion of these contact pins nevertheless remains possible. A further setting of the contact pressure dependent on the bearing prestress of the spring clip 6 can be carried out in an easy way.

The free end of the flexfoil is provided with transversely running projections 3', 3'', which are secured in the slits 2' and 2'', as a result of which the free end of the flexfoil is not easily pushed too far into the insert hole 5. Moreover, it is also prevented that the end of the flexfoil is pushed away during insertion of the pin.

The flexfoil end part is preferably introduced so far into the recess 2 that at least the free edge of this flexfoil 3 is clamped between the end edge of the spring clip 6 and the bearing surface of the bearing lug 12. This prevents the flexfoil 3 from being pushed further by insertion of the contact pins.

Figure 3:
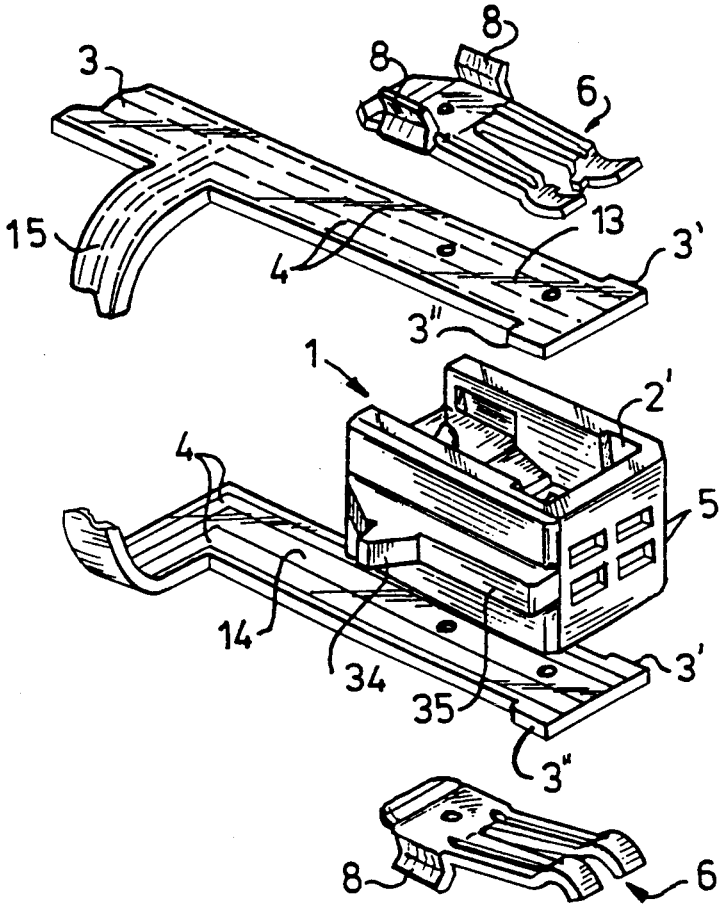
FIG. 3 shows a plan view of a four-position connector according to the invention with disassembled lower parts.

In FIG. 3, a four-position connector is illustrated, the body 1 of which is provided with two recesses 2, of which only the uppermost recess is visible in FIG. 3. However, both recesses 2 are visible in the cross-section shown in FIG. 4.

Figure 4:
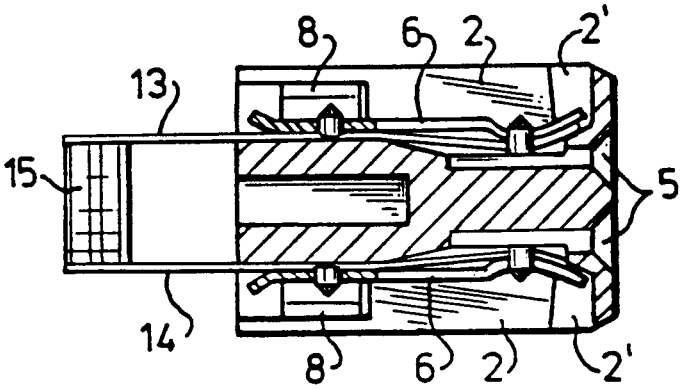
FIG. 4 shows a sectional view of an assembled connector according to FIG. 3.

The body 1 of the design shown in FIGS. 3 and 4 has two pairs of insert holes 5 lying next to each other.

In the case of the connector according to FIGS. 3 and 4, use may be made of a flexfoil 3, which has two free end parts 13 and 14, joined by a connecting part 15. In this way, 4 conductor tracks of the flexfoil 3 are contacted to 4 contact pins (not shown). The said end parts 13 and 14 are securely held in the corresponding recesses 2 by the respective spring clips 6, while the conductor tracks are pushed until approximately in the insert holes 5. As FIGS. 3 and 4 reveal, the spring clip 6 is of a similar design to that of FIGS. 1 and 2.

Figure 5:
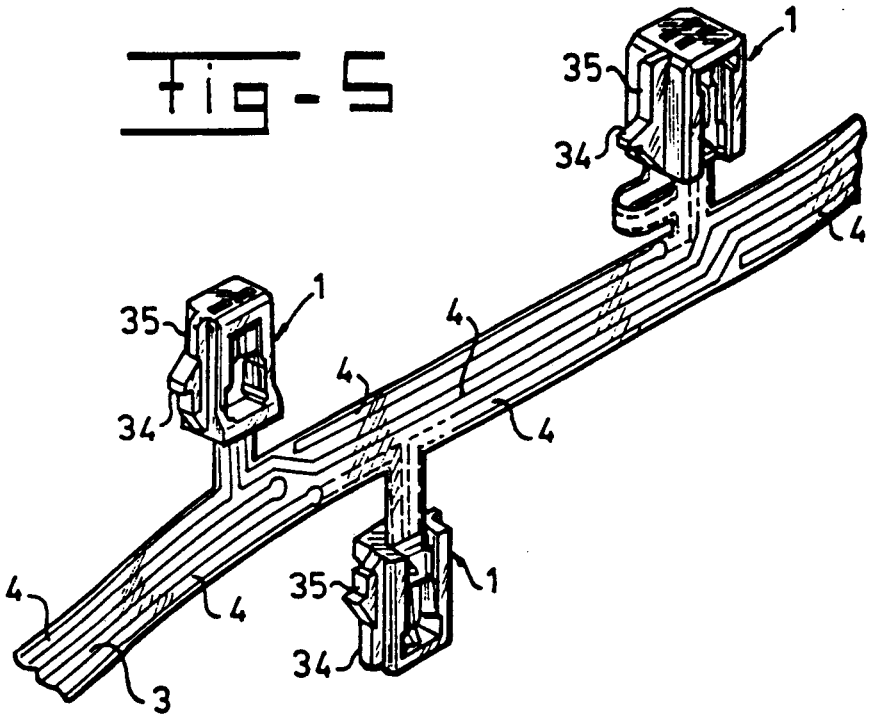
FIG. 5 shows a plan view of a flexfoil with a plurality of connectors according to the invention.

In FIG. 5, a flexfoil 3 is shown, using for example two two-position connectors and one four-position connector, the bodies of which are indicated by 1. It is clear that, depending on the number of conductor tracks 4, the number of connectors and the pattern of the conductor tracks, any number of connections between the respective conductor tracks and any number of contact pins can be produced.

Figure 7:
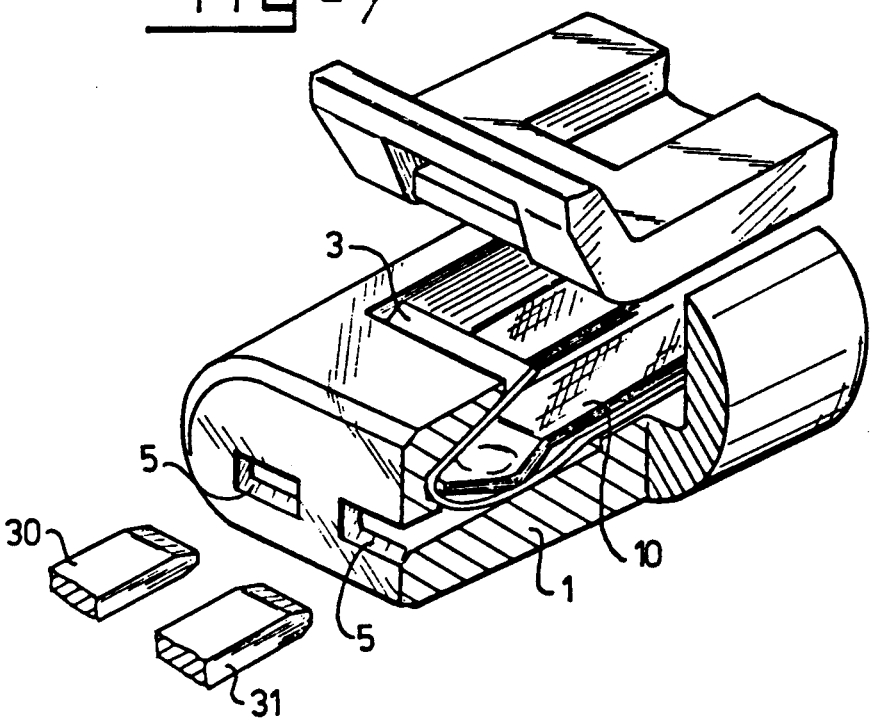
FIG. 7 shows a sectional view of a connector according to FIG. 6.
Figure 5:
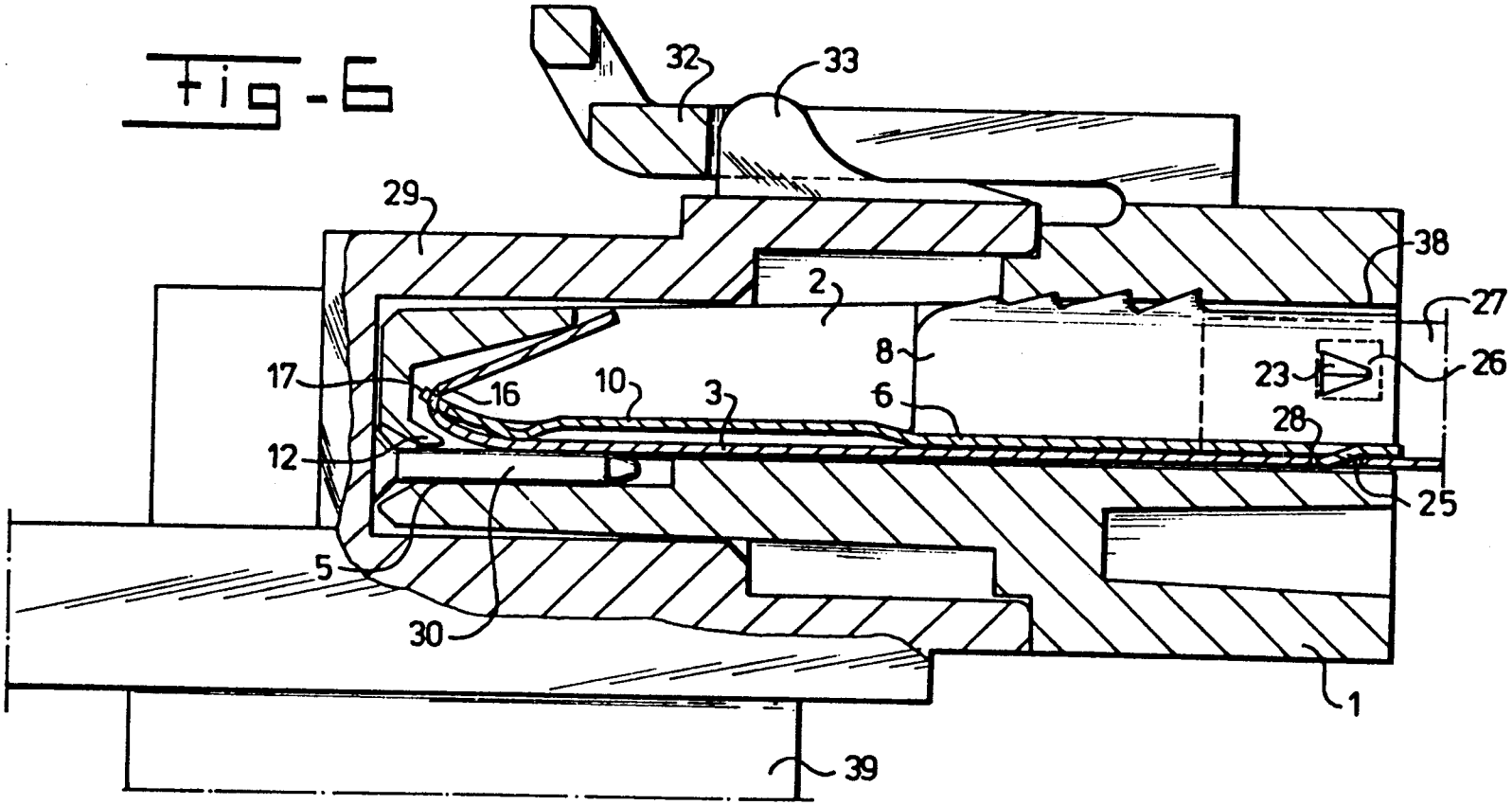

A further development of the connector according to the invention is shown in FIGS. 6 and 7, to be precise a further two-position connector. This connector again comprises a body 1 in which two insert holes 5 are provided. A different method of fastening the spring clip 6 is used in the case of the connector according to FIGS. 6, 7 and 8. In this embodiment, the end face of the fastening lugs 8 formed on the spring clip 6 and bent away are of a sawtooth-like design. If the spring clip 6 is inserted into the recess 2 and pushed, the sawteeth engage in the upper wall 38 of the recess 2 and push themselves into this wall. As a result, the spring clip 6 is securely held in its end position. In the assembled state, the conductor tracks 4 of the flexfoil 3 are pushed down by the spring clip 6 until approximately in the insert holes 5. The spring clip legs 10 are provided at their free ends with narrower engaging projections 17, which engage in the holes 16 made in flexfoil 3 and consequently secure the flexfoil also at the free end, thus preventing the flexfoil from being slipping away during insertion of the contact pins 30, 31.

Bearing lugs 12 for the free ends of the spring clip legs 10 are also provided in the design of the connector shown in FIGS. 6 and 7. In this design, the end of the flexfoil is securely held both by its clamping between the free ends of the spring clip legs and the bearing surface of the bearing lugs 12 and by the engaging of the projections 17 in the holes 16 in the recess 2.

In the designs described above, the body 2 is in each case also provided with an additional pull relief for the flexfoil 3. According to FIG. 2, the bottom of the recess 2 is provided with two pull-relief pins 18 and 19, which pins fit into corresponding holes 20 and 21 when the connector is in the assembled state. The said pins also run through holes 22 provided in the spring clips 6. It is clear that the connector according to FIGS. 3 and 4 has four pull-relief pins.

The pull relief of the flexfoil 3 is achieved in the case of the version shown in FIGS. 6 and 7 by means of the projections 23, 24 and 25, of which 24 is not visible, in the fastening lugs 8 or bottom surface of the spring clip 6, which projections 23 and 24 engage in corresponding holes 26 in parts 27 of the flexfoil 3 which are bent away in the direction of the lugs 8. The part 27 of the flexfoil 3 is thus bent up transversely with respect to the surface of the flexfoil. The projection 25 engages in the hole 28.

In FIG. 6 there is also depicted a counter-connector 29, interacting with the body 1 of the connector according to the invention. The contact pins 30 and 31 are located in a recess, in which the body 1 can be inserted. The connector and the counter-connector are provided with intermeshing locking elements 32 and 33. In the version shown, the counter-connector 29 is connected to a coil 39.

The bodies 1 according to FIGS. 1–5 have longitudinal webs 35, which are provided with locking projections 34 and interact with corresponding grooves in the counter-connector.

Figure 8:
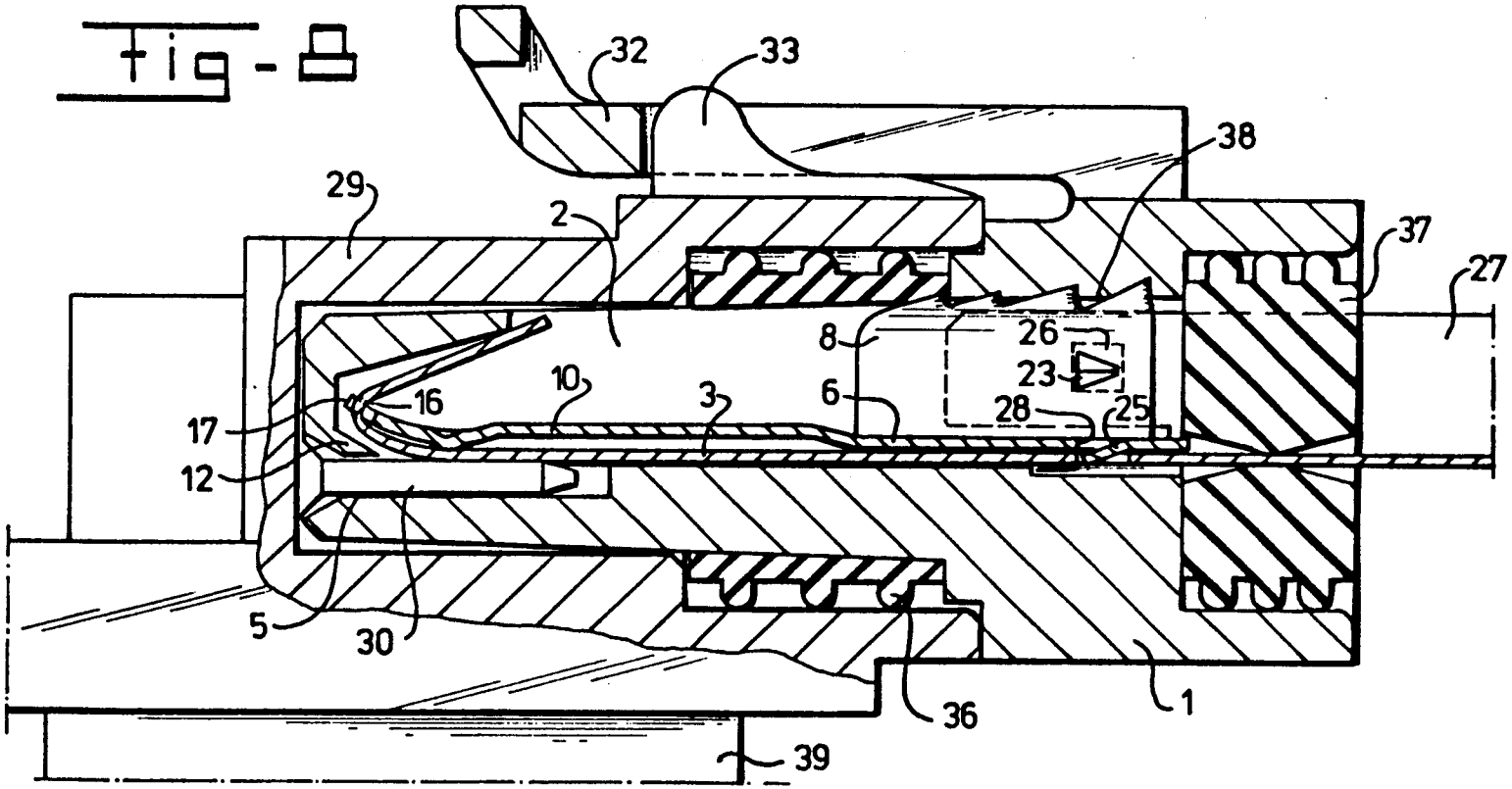
FIG. 8 shows a sectional view of a modified connector.

In FIG. 8 there is also drawn an embodiment of a connector according to the invention using sealing elements 36 and 37. The other component parts of this connector 1 and counter-connector 29 are similar to those of the connectors and counter-connectors of FIGS. 6 and 7.

What is claimed is:

1. A connector for electrically interconnecting conductor tracks on one side of a flexible circuit substrate to corresponding electrical contacts insertable into said connector comprising:

a housing of insulating material provided with apertures for receiving said electrical contacts and also provided with a recess for receiving at least a portion of said flexible circuit substrate, a spring clip disposed in said recess so that the conductor tracks on said one side of the flexible circuit substrate face said corresponding electrical contacts inserted in said apertures, said spring clip bearing against the other side of the flexible substrate to press said conductor tracks into electrical contact with respective ones of said electrical contacts, said spring clip being provided with strip-like legs having free ends disposed adjacent said apertures for applying pressure on said other side of the flexible subsrate and having at its side edges fastening elements for engaging respective walls of said recess.

2. A connector according to claim 1 wherein the recess wall of the housing against which said flexible substrate bears is provided with at least one pin for engaging in a hole provided in said flexible substrate.

3. A connector according to claim 1, wherein the fastening elements of the spring clip have resilient fastening lugs extending transversely with respect to a surface of said spring clip, the free end of said fastening lugs being outwardly bent away and the distances between the free ends of said lugs being greater than the distance between said respective recess walls adjacent to said free ends, said recess walls having wall clearances enabling the corresponding lug ends to snap into place.

4. A connector according to claim 3 wherein an outer surface of the fastening lugs of the spring clip are provided with pull relief projections for engaging in holes provided in the flexible substrate adjacent to the lugs.

5. A connector according to claim 1 wherein the fastening elements of the spring clip have fastening lugs extending transversely with respect to a surface of said spring clip, the end faces of said lugs being of the shape of sawteeth which engage in respective walls of said recess adjacent to these end faces, said walls having clearances formed by the sawteeth end faces during insertion of the spring clip, said sawteeth faces having tips which lie in a plane running at an acute angle with respect to said surface of the spring clip.

6. A connector according to claim 5 wherein the acute angle is 5°.

7. A connector according to claim 1 wherein the free ends of said spring clip legs each have a portion curved to press against said flexible substrate.

8. A connector according to claim 7 wherein the free ends the spring clip legs disposed adjacent said apertures have a narrowed projection for engaging respective holes provided in the flexible circuit substrate.

9. A connector according to claim 7 wherein said housing is provided at an inner portion of each said aperture with an inwardly protruding bearing lug, each said free end of the spring clip legs being prestressed against a corresponding bearing lug.

10. A connector according to claim 1 wherein the walls of the recess of said housing disposed adjacent to longitudinal edges of the flexible substrate are provided above said apertures with slits for receiving projections provided at the forward end of said flexible substrate to position and maintain the flexible substrate in place when the contacts are inserted into said apertures.

11. A connector according to claims 9 or 10 wherein the flexible substrate extends in the housing until it reaches the free ends of spring clip legs and the bearing lugs.

* * * * *